United States Patent [19]

Komatsu

[11] 4,075,375

[45] Feb. 21, 1978

[54] CLEANING MATERIAL AND PROCESS FOR PREPARATION THEREOF

[75] Inventor: Toshiyoshi Komatsu, Osaka, Japan

[73] Assignee: Duskin Franchise Co. Ltd., Osaka, Japan

[21] Appl. No.: 653,735

[22] Filed: Jan. 30, 1976

[51] Int. Cl.[2] ..... B05D 3/02

[52] U.S. Cl. ..... 427/390 R; 8/142; 15/104.93; 106/15 R; 252/88; 428/290; 428/290

[58] Field of Search ..... 15/104.93; 252/88; 427/390 R; 8/142; 106/15 R

[56] References Cited

U.S. PATENT DOCUMENTS

| | | | |
|---|---|---|---|
| 3,200,036 | 8/1965 | Greenblatt | 252/88 X |
| 3,391,079 | 7/1968 | Greenblatt | 252/88 X |
| 3,740,190 | 6/1973 | Ware | 252/88 X |

*Primary Examiner*—Michael R. Lusignan
*Attorney, Agent, or Firm*—Sherman & Shalloway

[57] ABSTRACT

A process for the preparation of cleaning materials comprising a cleaning fibrous substrate and an oiling composition adsorbed and impregnated in said fibrous substrate, said process comprising contacting a cleaning fibrous substrate composed of cellulose fibers or a combination of up to 30 % by weight, based on the total fibers, of synthetic fibers and the remainder of cellulose fibers with an oil-in-water emulsion of an oiling composition consisting substantially of (a) an oiling agent composed of mineral oil, a synthetic lubricating oil or a mixture thereof and having a viscosity of 8 to 100 cps as measured at 100° F., (b) 0.5 to 35 % by weight, based on the total oiling composition, of an amphoteric surface active agent or a surface active agent having in the molecule both cationic active and non-ionic active groups and (c) 0.3 to 5.0 % by weight, based on the total oiling composition, of a benzene-carboxylic acid ester having a solubility parameter of from 8 to 12.6, under such a pH condition that said surface active agent is allowed to exert a cationic activity, for a time sufficient for the emulsion to be rendered transparent, the oiling composition being present in an amount of 0.5 to 35% by weight based on the fibrous substrate on the dry basis; dehydrating the thus oil-impregnated fibrous substrate; and then drying the fibrous substrate.

18 Claims, No Drawings

CLEANING MATERIAL AND PROCESS FOR PREPARATION THEREOF

This invention relates to a cleaning material comprising a cleaning fibrous substrate such as mop, mat, wiping cloth or the like and an oiling composition adsorbed and impregnated in said fibrous substrate, and to a process for the preparation of this cleaning material.

Oil-impregnated fibrous articles represented by mops have heretofore been used for cleaning floors and the like. Recently, these cleaning fibrous articles are also used for removing dust deposited on walls, furniture, book cases and the like for both business purposes and ordinary household purposes because of changes in the living and working environments.

These oil-impregnated cleaning fibrous articles are required to have the following properties. Namely, on the cleaning operation, they should not scatter dust around surroundings and hold tightly adsorbed dust on the surfaces of fibers without re-scattering of dust, and they should not leave on the surface to be cleaned a substantial oil film of the oiling composition impregnated in the fibrous substrate. Especially in the case of wiping cloths, selection of an oiling composition having a high safety without toxic characteristics such as skin-irritating property should naturally be desired because the wiping operation is directly performed by hand.

A so-called self-emulsifiable oiling composition comprising a mineral oil, a cationic surface active agent and a non-ionic surface active agent, such as disclosed in the specification of U.S. Pat. No. 3,200,036, is used as the oiling composition to be impregnated in the cleaning fibrous substrate. Most known oiling compositions of this type are satisfactory for attaining the object of adsorbing the oiling composition in the emulsified state into fibers, but they are still insufficient for attaining the object of adsorbing the oiling composition uniformly and tightly on the fibrous substrate.

In known self-emulsifiable oiling compositions, since a non-ionic surface active agent is incorporated, a part of the oiling composition is readily re-emulsified and flown away when water is removed from treated fibers. Accordingly, drastic dehydration of treated fibers should be withheld and therefore, the subsequent drying step should be conducted for a long time. Further, non-ionic surface active agents are generally poor in heat resistance and they are readily released into open air as white fumes at the drying step.

It is also known that the presence of a non-ionic surface active agent retards the adsorption and impregnation speed of the emulsion into the fibrous substrate and weakens the adhesion strength of the oiling composition to fibers.

Oil-impregnated cleaning fibers are generally washed after they have been used for a certain period, and dusts or contaminants adsorbed are removed and the washed fibers are subjected to the oil-impregnating operation again for repeated use. The non-ionic surface active agent contained in waste water discharged from this washing step is hardly separated from this waste water even if it is subjected to the purification treatment. Accordingly, it is discharged in the state contained in waste water, causing environmental pollution.

In view of the foregoing, an oiling composition to be impregnated in a cleaning fibrous substrate is required to have the following two properties. More specifically, when the composition is formed into an oil-in-water emuslion, a fine and uniform dispersion should be maintained in particles of the oiling composition at least during the period for treating the fibrous substrate, and the dispersed particles of the oiling composition should be completely adsorbed in the fibrous substrate promptly in a suitable time and the oiling composition should be converted from an opaque emulsion to a transparent liquid. However, oiling compositions excellent in the emulsion stability in water are generally insufficient in the property of being adsorbed in the fibrous substrate promptly in a suitable time. Namely, in the case of these oiling compositions, even if the treatment is conducted for a long time, they are hardly adsorbed in the fibrous substrate tightly and completely or the opaque emulsions are hardly converted to transparent liquids from which the oiling composition has been exhausted into the fibrous substrate. On the other hand, oiling compositions which are promptly adsorbed in the fibrous substrate in the state emulsified in water are generally insufficient in the emulsion stability in water. Therefore, uneven adsorption readily takes place. As is seen from the foregoing illustration, it is generally difficult to impart both the above-mentioned two properties simultaneously to known self-emulsifiable oiling compositons.

In case an oiling composition is loosely adsorbed because of lack of the former property or in case an oiling composition is unevenly adsorbed because of lack of the latter property, the oiling composition is readily transferred from the fibrous substrate to the surfaces (surfaces to be wiped) of floors, furniture, desks, walls and the like and left on these surfaces as a dust-adsorbing oil film. If a hand or wearing cloth falls in contact with this oily film, the hand or cloth is readily contaminated.

It is therefore a primary object of this invention to provide a cleaning material which comprises a fibrous substrate impregnated with a novel self-emulsifiable oiling composition which is free of a non-ionic surface active agent, the use of which is indispensable in conventional cleaning materials.

Another object of this invention is to provide a process for the preparation of oil-impregnated cleaning fibers in which a novel self-emulsifiable oiling composition is used and the above-mentioned various shortcomings brought about by using non-ionic surface active agents can be fully moderated and overcome.

Still another object of this invention is to provide a process for the preparation of a self-emulsifiable oiling composition having such properties that when it is formed into an oil-in-water emulsion and the emulsion is applied to a fibrous substrate, a fine and uniform dispersion state can be maintained in particles of the oiling composition at least during the time of treating the fibrous substrate, and the dispersed particles of the oiling composition are completely adsorbed in the fibrous substrate promptly in a suitable time and the opaque emulsion is converted to a transparent liquid; and a process for preparing oil-impregnated cleaning fibers by using this self-emulsifiable oiling composition having such improved properties.

I found that when an oiling composition comprising a major amount of a mineral oil, a synthetic lubricating oil or a mixture thereof having a viscosity of 8 to 100 cps (centipoises) as measured at 100° F., a specific amount of an amphoteric surface active agent or a surface active agent having in the molecule both cationic active and non-ionic active groups and a specific amount of an emulsion stabilizer composed of a benzene-carboxylic acid ester having a solubility parameter, detailed hereinafter, of from 8 to 12.6 is contacted with a fibrous substrate in the form of an oil-in-water emulsion under such a pH condition that said surface active agent is allowed to exert a cationic activity to thereby impregnate and adsorb the oiling composition into the fibrous substrate, the foregoing various shortcomings and disadvantages involved in the conventional techniques can be effectively overcome.

I also found that a cleaning material comprising a fibrous substrate prepared according to the above-mentioned process using the above-mentioned specific oiling composition has such excellent dust-controlling characteristics that dust is not scattered around surroundings on the cleaning operation, dust is tightly held on the surfaces of fibers without re-scattering and the oiling composition is not transferred onto the wiped surfaces.

I have now completed this invention based on these findings.

More specifically, in accordance with this invention, there is provided a process for the preparation of cleaning materials comprising a cleaning fibrous substrate and an oiling composition adsorbed and impregnated in said fibrous substrate, said process comprising contacting a cleaning fibrous substrate composed of cellulose fibers or a combination of up to 30% by weight, based on the total fibers, of synthetic fibers and the remainder of cellulose fibers with an oil-in-water emulsion of an oiling composition consisting essentially of (a) an oiling agent composed of a mineral oil, a synthetic lubricating oil or a mixture thereof and having a viscosity of 8 to 100 cps as measured at 100° F., (b) 0.5 to 35% by weight, based on the total oiling composition, of an amphoteric surface active agent or a surface active agent having in the molecule both cationic active and non-ionic active groups and (c) 0.3 to 5.0% by weight, based on the total oiling composition, of a benzene-carboxylic acid ester having a solubility parameter of from 8 to 12.6, under such a pH condition that said surface active agent is allowed to exert a cationic activity, for a time sufficient for the emulsion to be rendered transparent, the oiling composition being present in an amount of 0.5 to 35% by weight based on the fibrous substrate on the dry basis; dehydrating the thus oil-impregnated fibrous substrate; and then drying the fibrous substrate.

In the oiling composition of the present invention, in order to attain good dust adsorbing property and good emulsion characteristics, a known mineral oil or synthetic lubricating oil having a viscosity of 8 to 100 cps (centipoises), preferably 10 to 90 cps, as measured at 100° F. is used as an oiling agent. These mineral oils or synthetic lubricating oils may be used singly or in mixtures of two or more of them. These oiling agents are non-volatile (non-drying) in the normal condition (at 20° C. and atmospheric pressure), and it is preferred that these oiling agents have a flashing point of at least 130° C., a vapor pressure lower than 1 mm Hg as measured at 70° C., an aniline point of at least 20 and a boiling point of at least 280° C.

Any of various mineral oils composed of paraffinic hydrocarbons, naphthenic hydrocarbons, aromatic hydrocarbons or mixtures thereof can be used in this invention, so far as the above requirement of the viscosity is satisfied. As a typical instance of the mineral oil that can be used in this invention, there can be mentioned liquid paraffin. Further, spindle oil, machine oil, refrigerating machine oil and other known petroleum type lubricating oils can be used in this invention.

As the synthetic lubricating oil, polyolefin oils ( α-olefin oils ), polyglycol oils, polybutene oils, alkylbenzene oils (alkylated oils) and other known synthetic lubricating oils can be used singly or in the form of a mixture of two or more of them, so far as the requirement of the viscosity is satisfied.

For attaining the objects of the present invention, use of liquid paraffin, namely a highly purified hydrocarbon oil obtained by sulfuric acid scrubbing of a spindle oil fraction, is most preferred, and an alkylbenzene oil comes next.

The oiling agent (a) such as mentioned above is used in a major amount, generally at least 60% by weight, preferably at least 80% by weight, based on the total oiling composition.

One of important features of this invention is that as the surface active agent (b) for imparting the self-emulsifiability in water and the self-exhausting property in fibers to the oiling agent, a non-ionic surface active agent is not used but a known amphoteric surface agent, namely a surface active agent having in the molecule both a cationic active group such as a quaternary ammonium group or a primary, secondary or tertiary amino group and an anionic active group such as a carboxylic or sulfonic acid group, or a known surface active agent having in the molecule both a cationic active group such as mentioned above and a non-ionic active group such as a polyethylene oxide group is used.

As preferred examples of the amphoteric surface active agent that can be used in this invention, the following compounds can be mentioned:

(1) Betaine type surface active agents represented by the following general formula:

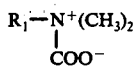

(1)

wherein $R_1$ stands for a long-chain alkyl group.

(2) 1-Hydroxyethyl-1-carboxymethyl-2-long-chain-alkyl-imidazolines represented by the following general formula:

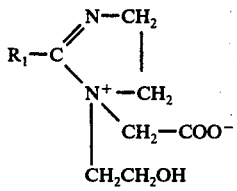

(2)

wherein $R_1$ stands for a long-chain alkyl group.

(3) Glycine derivatives represented by the following general formula:

$$R_1\text{-}(NHC_2H_4)_q NHCH_2COOH \quad (3)$$

wherein $R_1$ stands for a long-chain alkyl group and $q$ is a number of 1 to 8, especially 2 to 5.

(4) Compounds represented by the following general formula:

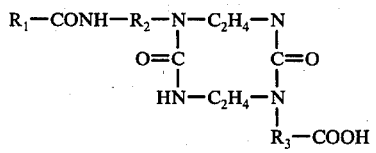

(4)

wherein $R_1$ stands for a long-chain alkyl group and $R_2$ and $R_3$ stand for a alkylene group having up to 3 carbon atoms.

(5) Lecithin (6) Amine oxide represented by the following general formula:

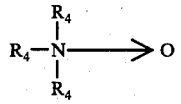

(5)

wherein $R_4$ stands for an alkyl or hydroxyalkyl group having up to 4 carbon atoms.

In the instant specification, by the term " long-chain alkyl group " is meant an alkyl group having at least 8 carbon atoms, especially 11 to 21 carbon atoms.

As the surface active agent having in the molecule both cationic active and non-ionic active groups, there can be mentioned, for example, adducts of lower alkylene oxides such as ethylene oxide and propylene oxide to known cationic surface active agents having active hydrogen atoms. As preferred examples of such surface active agent, the following compounds can be mentioned:

(1) Compounds represented by the following general formula:

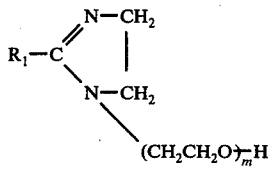

(6)

wherein $R_1$ stands for a long-chain alkyl group and $m$ is a number of from 2 to 5, especially 3.

(2) Compounds represented by the following general formula:

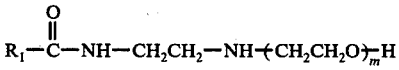

(7)

wherein $R_1$ stands for a long-chain alkyl group and $m$ is a number of from 2 to 5, especially 3.

(3) Compounds represented by the following general formula:

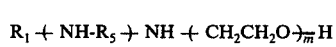

wherein $R_1$ stands for a long-chain alkyl group, $R_5$ stands for an alkylene group having 2 to 3 carbon atoms, $p$ is 0 or 1, and $m$ is a number of from 2 to 5.

An especially preferred surface active agent is a mixture containing an activating agent of above formula (6) and an activating agent of above formula (7) at a weight ratio ranging from 5 : 5 to 9 : 1.

In the present invention, by virtue of the feature that as the surface active agent, a non-ionic surface active agent is not used but the above-mentioned amphoteric surface active agent or surface active agent having in the molecule both cationic active and non-ionic active groups is used, it is made possible to adsorb oil drops of the oiling composition tightly into the fibrous substrate and to prevent occurrence of an undesired phenomenon that the adsorbed oiling composition is flown away when the oil-impregnated fibers are subjected to the dehydration treatment.

The above-mentioned specific surface active agent (b) is used in an amount of 0.5 to 35% by weight, especially 1 to 30% by weight, based on the total oiling composition. This is another important feature of the present invention. When the amount of the surface active agent used is smaller than 0.5% by weight based on the oiling composition, it is difficult to adsorb the oiling composition in fibers promptly in a suitable time. Use of the surface active agent (b) in an amount larger than 35% by weight based on the oiling composition is not preferred from the economical viewpoint and results in reduction of the dust-adsorbing property.

In this invention, since the above-mentioned amphoteric surface active agent or surface active agent having in the molecule both cationic active and non-ionic active groups is used as the surface active agent (b), in order to impart good emulsifiability and dispersibility and good exhausting property in fibers to the oiling composition, it is important that a benzene-carboxylic acid ester having a solubility parameter of from 8 to 12.6, especially from 9 to 12.6, should be incorporated in an amount of 0.3 to 5% by weight, preferably 1 to 4% by weight, based on the oiling composition. If the amount of this stabilizer is smaller than 0.3% by weight based on the oiling composition, it is difficult to keep the emulsion particles in the fine and uniform state stably and uneven adsorption is readily caused. Further, it is difficult to bond the oiling composition tightly to fibers. If the amount of the stabilizer is larger than 5% by weight based on the oiling composition, the stability of the emulsion becomes too high and it is difficult to adsorb the oiling composition on fibers even after passage of a long time. Furthermore, the once adsorbed oiling composition is readily re-emulsified and separates from the fibers. These facts will readily be understood from experimental data shown in Tables 7 and 9 given hereinafter.

By the term "solubility parameter" referred to in the instant specification is meant a value determined according to the method disclosed in J. Appl. Chem., 3, pp. 71–76, February 1953. More specifically, the solubility parameter (S.P.) is defined as the square root of the cohesive energy density. From experimental data shown in Table 1 given hereinafter, it will readily be understood that the use of a benzene-carboxylic acid ester having a solubility parameter of from 8 to 12.6 is very important for the stability of an emulsion of the oiling composition.

Benzene-carboxylic acid esters that are preferably used in this invention can be expressed by the following general formula:

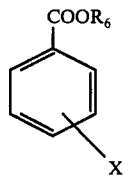

(8)

wherein $R_6$ stands for an alkyl group having up to 6 carbon atoms, most preferably a butyl group, and X stands for a hydrogen atom, a hydroxyl group, an alkyl or alkoxy group having up to 6 carbon atoms or a group $-COOR_6$.

As preferred esters, there can be mentioned, in an order of importance, butyl benzoate (S.P. = 9.42), dibutyl phthalate (S.P. = 9.67), butyl p-hydroxybenzoate (12.56), butyl salicylate (S.P. = 10.07), butyl p-toluate and butyl p-anisate.

In order to clarify the criticality of the solubility parameter value (S.P. value), the emulsified states at a pH of 4.5 of self-emulsifiable compositions containing a prescribed amount of a benzene-carboxylic acid ester to be used in the present invention or an analogue thereof, 93 parts by weight of liquid paraffin and 3 parts by weight of a surface active agent shown in Example 1 given hereinafter were examined to obtain results shown in Table 1.

Table 1

| Compound | S.P. Value | Emulsified State* 0.5 Part by weight | 1 Part by weight | 2 Parts by weight | 3 Parts by weight |
|---|---|---|---|---|---|
| butyl salicylate | 10.07 | B | B | B | B |
| butyl p-hydroxybenzoate | 12.56 | C | A | A | B |
| butyl benzoate | 9.42 | B | A | A | B |
| dibutyl phthalate | 9.67 | B | A | A | B |
| p-hydroxybenzoic acid | 13.97 | C | D | D | D |
| salicylic acid | 13.73 | C | D | D | D |
| o-anisic acid | 13.01 | D | D | D | D |

*The emulsified state was evaluated according to the following scale:
A: excellent
B: good
C: moderate
D: bad Known assistants may be incorporated into the oiling composition of the present invention. For example, known additives such as perfumes, fluorescent whitening agents, oil-soluble dyes, flame retardants, fire-proofing agents, fungicides and mildewcides may be incorporated into the oiling composition of the present invention according to known recipes.

In order to improve the permeability of the oiling composition into the fibrous substrate and the dispersibility of the composition in water, it is preferred that a water-miscible organic solvent be incorporated in an amount of 0.3 to 8% by weight, especially 0.5 to 8% by weight, based on the oiling composition. As such water-miscible organic solvent, there can be mentioned, for example, methanol, ethyl alcohol, isopropanol, ethylene glycol, diethylene glycol, propylene glycol, methyl Cellosolve (ethylene glycol monoethylether), ethyl Cellosolve (ethylene glycol monoethylether), butyl Cellosolve (ethylene glycol monobutylether), glycerin, monoethanol amine, diethanol amine and triethanol amine.

Known textiles such as mop, mat, rug, wiping cloth and the like are used as the fibrous substrate of the cleaning material of this invention. It is preferred that the fibrous substrate be composed of cellulose fibers such as cotton fibers, mercerized cotton fibers and regenerated cellulose fibers, e.g., rayon. In this invention, synthetic fibers such as polyvinyl alcohol fibers, polyamide fibers, polyacrylic fibers and polyester fibers may be incorporated in amounts not damaging inherent properties of cellulose fibers, for example, in amounts of up to 30% by weight based on the total fibers constituting the fibrous substrate. The fibrous substrate is used in the form of a twisted yarn or cord, e.g., mop, a woven fabric, e.g., cloth, a tufted fabric, e.g., a mat, a knitted fabric or a non-woven fabric.

The amount of the oiling composition to be adsorbed and impregnated in the fibrous substrate may optionally be changed depending on the intended use of the cleaning material. However, it is generally preferred that the amount of the oiling composition be 8 to 50% by weight, especially 10 to 35% by weight, based on the fibrous substrate on the dry basis. When the amount of the oiling composition is smaller than 8% by weight based on the fiber, a satisfactory dust-collecting property or a good durability of the dust-collecting effect cannot be obtained. In contrast, when the amount of the oiling composition exceeds 50% by weight based on the fibers, the tendency of the oiling composition adsorbed in the fiber substrate to be left on the wiped surfaces is enhanced, and no satisfactory dust-controlling article can be obtained.

In practising the process of the present invention, in order to attain the objects of this invention, it is very important that the fibrous substrate should be treated with an emulsion of the oiling composition under such a pH condition that the above-mentioned surface active agent (b) is allowed to exert a cationic activity. More specifically, it is preferred that the treatment be conducted under such a pH condition that the zeta ($\zeta$) potential of an electrically double layer formed on the interface between the oiling composition as the dispersed phase and water as the dispersion medium is positive. In order to attain the pH condition, an organic acid such as acetic acid, propionic acid, citric acid, tartaric acid, succinic acid or the like is added to an aqueous medium to be used for treating the fibrous substrate with the oiling composition, so that the pH of the aqueous medium is lower than the pH at the isoelectric point of the surface active agent (b) used (the zeta potential of the oil particles in the emulsion becomes zero at the isoelectric point). In many cases, satisfactory results are obtained when the pH of the aqueous medium is adjusted to 4.0 to 5.0. In addition to organic carboxylic acids mentioned above, a mineral acid such as hydrochloric acid, sulfuric acid or the like can be used as the acidifying agent. In the present invention, use of acetic acid is most preferred.

Another important condition when treating the fibrous substrate with an emulsion of the oiling composition is that dispersed particles of the oiling composition should be kept fine and uniform in the size and the time of exhaustion of these particles into fibers should be controlled within a suitable range. In the present invention, since the specific surface active agent (b) and emulsion stabilizer (c) are used in specific amounts, such a specific particle size distribution can be attained in the emulsified oil particles that the number of particles having a size smaller than 10 $\mu$ occupies at least 80%, preferably at least 90%, of the total number of particles. By virtue of this particle size distribution, it is made possible to prevent uneven adsorption of the oiling composition in the fibrous substrate. If the time for exhaustion or adsorption of the dispersed particles of the oiling composition into fibers is too short, the dispersed particles cohesively adhere to one another, causing uneven adsorption, and especially in the case of a thick-twisted plyed cord, e.g., a mop, the oiling composition adheres preferentially to the outer side portion or top end portion of the cord and it is difficult to adsorb and impregnate the oiling agent into individual fibers in the interior of the fibrous substrate. On the other hand, if this absorption time is too long, various difficulties are invited in practising the impregnation step and various defects such as mentioned above are brought about. When the oiling composition of the present invention is used, it is made possible to adsorb and impregnate the composition into fibers by conducting the treatment for 5 to 20 minutes, preferably 8 to 15 minutes, and the foregoing defects involved in the conventional techniques can be overcome effectively.

Other treatment conditions are not particularly critical. The treatment may be conducted at a temperature of 5° to 70° C., preferably 20° to 40° C. In general, good results can be obtained when the treatment is carried out at room temperature.

The treatment of the fibrous substrate with an emulsion of the oiling composition can be performed batchwise or in a continuous manner. This treatment can be accomplished most simply by immersing the fibrous substrate in the emulsion of the oiling composition. It is also possible to spray the emulsion to the fibrous substrate. When the fibrous substrate is continuously treated with an emulsion of the oiling composition, the fibrous substrate is contacted with the emulsion in a counter-current or parallel flow manner.

After the above-mentioned impregnation treatment, the fibrous substrate is subjected to the dehydration treatment so that the water content in the fibers is reduced to a level lower than 70% by weight, preferably lower than 60% by weight. In the present invention, by virtue of the use of a combination of the specific surface active agent (b) and the specific emulsion stabilizer (c), although the fibrous substrate is highly dehydrated, the adsorbed oiling composition is not substantially desorbed by re-emulsification. This is one of prominent effects attained by the present invention. The dehydration can easily be accomplished by using known dehydrating machines, for example, a centrifugal dehydrating machine, a pressing dehydrating machine, e.g., a pressing roll, and a vacuum dehydrating machine.

After the dehydration treatment, the oil-impregnated fibrous substrate is dried at a temperature of 60° to 80° C. and a final cleaning product is obtained. When the oiling composition of the present invention is not used, undesired phenomena such as generation of white fumes and scattering of the oiling agent are not caused to occur at all.

The process of the present invention can be applied to not only fresh fibrous substrates but also used and contaminated, oil-impregnated cleaning fibrous substrates for regeneration thereof. These used and contaminated cleaning fibrous substrates are subjected to the washing treatment with water and a known washing solution containing a surface active agent and a builder. After this washing treatment has been repeated the necessary number of times, the washed fibrous substrates are bleached and sterilized by using a suitable bleaching agent and then subjected to the above-mentioned treatment according to the present invention.

An industrial washer customarily used for washing clothings, bedclothes, sheets and the like can be used conveniently for performing the washing treatment or the oil impregnation treatment.

This invention will now be described in detail by reference to the following Examples that by no means limit the scope of the invention.

EXAMPLE 1

A self-emulsifiable oiling composition having the recipe I indicated in Table 2 was prepared by using a mixture containing 70% by weight of an amphoteric surface agent having both cationic active and non-ionic active groups and being represented by the following formula:

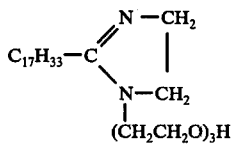

(A)

and 30% by weight of a compound represented by the following formula:

$$C_{17}H_{33}CONHCH_2CH_2NH(CH_2CH_2O)_3H \quad (B)$$

For comparison, a self-emulsifiable oiling composition having the recipe II indicated in Table 2 was prepared by using 2 parts by weight of oleyl-N-hydroxyethylimidazoline (Cationic Amine 220 manufactured by Union Carbide Corporation) as the cationic surface active agent and 1 part by weight of a polyoxyethylene alkylphenol ether (having an HLB value of 10.3).

Table 2

| Ingredients | Recipe I (% by weight) | Recipe II (% by weight) |
|---|---|---|
| liquid paraffin | 40 | 40 |
| alkylbenzene oil | 53 | 57 |
| surface active agents (A) and (B) | 3 | — |
| oleyl-N-hydroxyethylimidazoline | — | 2 |
| polyoxyethylene alkylphenol ether | — | 1 |

Table 2-continued

| Ingredients | Recipe I (% by weight) | Recipe II (% by weight) |
|---|---|---|
| butyl benzoate | 4 | — |

Fifty parts by weight of a mixed spun woven fabric composed of 90% by weight of cotton and 10% of rayon was rinsed in water maintained at 60° C. at a liquor ratio of 10:1, and the pH of the bath was adjusted to 4.5. Then, the composition of the above recipe I or II was incorporated into the bath in an amount of 10 parts by weight to form an emulsion. The emulsion was observed by a microscope to examine the size distribution in the dispersed oil particles. While the temperature was maintained at 40° C. under agitation, the fabric was dipped in this emulsion, and the time required for the bath to be made transparent by exhaustion of the oiling composition in the fibers was measured.

The resulting oil-impregnated fabric was dehydrated by a centrifugal dehydrating machine so that the water content was reduced below 60% by weight, and the amount of the activating agent flown into the waste water and the ratios of exhaustion of the oiling agent (oiling agent retention ratios) before and after the dehydration treatment were measured. After the dehydration treatment, the oil-impregnated fabric was dried at 80° C. for 30 minutes and the amount of the oiling agent evaporated into open air was determined.

The amount of the oiling agent evaporated was determined by measuring by gas chromatography the amount of the oiling agent collected when the exhaust gas was passed through carbon tetrachloride.

The amount of the dust adsorbed was determined in the following manner. In a 500-cc capacity broad-mouth bottle filled with 5 g of silica sand (M-3 manufactured by Maruo Calcium), 4 sample cloths (5 cm × 5 cm) were placed. The bottle was shaken vertically for 2 minutes. Then, the samples were taken out of the bottle and the dust shaking operation was conducted 100 times on a metal gauge of 30 mesh. The weight increase of the sample was measured, and the amount of the dust adsorbed was expressed in terms of this weight increase ($mg/cm^2$).

The amount of the oiling agent transferred on the wiped surface was determined in the following manner. A sample cloth (5 cm × 5 cm) was sandwiched with two filter papers No. 5 (manufactured by Toyo Roshi) and a load of 5 $g/cm^2$ was imposed, and the sample was allowed to stand still for 10 hours in a air-conditioned chamber maintained at a temperature of 20° C. and a relative humidity of 65%. The amount of the oiling agent transferred on the filter papers was measured as the weight increase ($\mu g/cm^2$) of the filter papers.

Obtained results are shown in Table 3. Each value in the Table is a mean value obtained by repeating the experiment 10 times. From the results shown in Table 3, it will readily be understood that when known oiling compositions including a non-ionic surface active agent are employed, the oiling compositions exhausted in fibers tend to be flown away at the dehydration step, whereas this tendency is much reduced in the case of oiling compositions of the present invention. It will also be understood that oil particles of an emulsion of the oiling composition of the present invention are tightly bonded to individual fibers of the fibrous substrate while being controlled to have a fine and uniform particle size.

Table 3

| | Recipe I | Recipe II |
|---|---|---|
| Distribution (numerical %) of particles smaller than 10 μ in emulsion | 96 | 80 |
| Time (minutes) of exhaustion in fibers | 12 | 20 |
| Ratio (%) of oiling agent flown in waste water at centrifugal dehydration | | |
| (i) cationic agent (based on amine value) | 0.5 | 19.5 |
| (ii) non-ionic agent | — | 11.5 |
| Oiling agent exhaustion ratio (%) (retention ratio) | | |
| (i) before dehydration | 99.1 | 98.9 |
| (ii) after dehydration | 99.0 | 88.0 |
| (iii) after drying | 99.0 | 88.0 |
| (iv) deviation in final product | 98.6–99.2 | 87.6–92 |
| Amount ($mg/Nm^3$) of oiling agent evaporated in air | 46 | 135 |
| Amount ($mg/cm^2$) of dust adsorbed | 26.3 | 23.4 |
| Amount ($\mu g/cm^2$) of oil transferred on wiped surface | 1.23 | 1.52 |

EXAMPLE 2

A self-emulsifiable oiling composition was prepared according to recipe III shown in Table 4 by using as the amphoteric surface active agent a compound having the following formula:

$$C_{12}H_{25}(NHC_2H_4)_2NHCH_2COOH \quad (C)$$

Table 4

| Ingredients | Recipe III (% by weight) |
|---|---|
| Liquid paraffin | 63 |
| Activating agent (C) | 27 |
| Ethylene glycol | 8 |
| Dibutyl phthalate | 2 |

In water was dipped 100 parts by weight of a cotton woven fabric at a liquor ratio of 10:1, and acetic acid was added to the bath to adjust the pH to 4.0. Then, 21 parts by weight of the self-emulsifiable oiling composition indicated in Table 4 was added to the bath to form an emulsion. While maintaining the liquid temperature at 30° C., the emulsion was agitated and the oiling composition was adsorbed and exhausted in the fibers. Post treatments were conducted in the same manner as described in Example 1 to obtain a final product. Obtained experimental results are shown in Table 5.

Table 5

| | Recipe III |
|---|---|
| Distribution (numerical %) of particles smaller than 10 μ in emulsion | 85 |
| Time (nimutes) of exhaustion in fibers | 15 |
| Ratio (%) of oiling agent flown in waste water at centrifugal dehydration | below 0.5 |
| Oiling agent exhaustion ratio (%) (retention ratio) | |
| (i) before dehydration | 99.1 |
| (ii) after dehydration | 99.0 |
| (iii) after drying | 98.8 |
| (iv) deviation in final product | 98.4–98.8 |
| Amount ($mg/Nm^3$) of oiling agent evapo- | 48 |

Table 5-continued

| | Recipe III |
|---|---|
| rated in air | |
| Amount (mg/cm$^2$) of dust adsorbed | 24.7 |
| Amount (μg/cm$^2$) of oil transferred on wiped surface | 1.18 |

EXAMPLE 3

Self-emulsifiable compositions were prepared according to the recipe shown in Table 6 by using an adduct (D) of 2 moles of ethylene oxide to 1 mole of isostearyl amine (Nimeen IS-202 manufactured by Nippon Yushi) as the surface agent having in the molecule both cationic active and non-ionic active groups.

Table 6

| Ingredients | Recipe (% by weight) | | | | | |
|---|---|---|---|---|---|---|
| | Run 1* | Run 2 | Run 3 | Run 4 | Run 5 | Run 6* |
| Liquid paraffin | 92 | 91.5 | 91.0 | 90.0 | 89.0 | 86.5 |
| Activating agent (D) | 3.0 | 3.0 | 3.0 | 3.0 | 3.0 | 3.0 |
| Butyl p-hydroxybenzoate | 0 | 0.5 | 1.0 | 2.0 | 3.0 | 5.5 |
| Isopropyl alcohol | 5 | 5 | 5 | 5 | 5 | 5 |

*Oiling compositions used in runs 1 and 6 were outside the scope of the present invention.

In water was dipped 100 parts by weight of a cotton cloth at a liquor ratio of 10 : 1, and the pH of the bath was adjusted to 4.5 by addition of maleic acid. Then, 20 parts by weight of the oiling composition was added to the bath to form an emulsion. The emulsion was agitated at 20° C. to adsorb oil particles in the cotton cloth. Post treatments were carried out in the same manner as in Example 1 to obtain results shown in Table 7.

Table 7

| Test Item | Run 1 | Run 2 | Run 3 | Run 4 | Run 5 | Run 6 |
|---|---|---|---|---|---|---|
| Distribution (numerical %) of particles smaller than 10 μ in emulsion | 80 | 90 | 94 | 95 | 96 | 73 |
| Time (minutes) of exhaustion in fibers | 10 | 15 | 18 | 20 | 30 | 7 |
| State of treating liquid after adsorption treatment | slightly opaque | trans-parent | trans-parent | trans-parent | trans-parent | trans-parent |
| Oiling agent exhaustion ratio (%) (retention ratio) | | | | | | |
| (i) before dehydration | 97.5 | 98.7 | 99.0 | 99.1 | 98.9 | 97.7 |
| (ii) after dehydration | 84.0 | 98.5 | 98.8 | 99.0 | 98.7 | 82.4 |
| (III) after drying | 82.0 | 98.3 | 98.8 | 99.0 | 98.7 | 82.0 |
| (iv) deviation in final product | 81.2–98.1 | 97.9–99.0 | 98.2–99.3 | 98.4–99.6 | 98.1–99.5 | 81.2–98.4 |
| Amount (mg/Nm$^3$) of oiling agent evaporated in air | 60 | 40 | 46 | 42 | 45 | 120 |
| Amount (mg/cm$^2$) of dust adsorbed | 23.8 | 24.2 | 25.0 | 24.7 | 23.8 | 20.7 |
| Amount (μg/cm$^2$) of oil transferred on wiped surface | 1.52 | 1.28 | 1.21 | 1.23 | 1.35 | 1.53 |

From the above results, it will readily be understood that when a benzene-carboxylic acid ester having a solubility parameter of from 8 to 12.6 is incorporated in an oiling composition in an amount of 0.3 to 5.0 % by weight, especially 1.0 to 4.0 by weight, the size of emulsified oil particles can be controlled to a fine and uniform size to prevent uneven adsorption of the oiling composition in fibers and strong adhesion of the oiling composition to the fibers can be obtained.

EXAMPLE 4

According to the recipe shown in Table 8, self-emulsifiable compositions were prepared by using as the surface active agent a combination of an adduct (E) of 3 moles of ethylene oxide to 1 mole of beef-tallow-alkylpropylene diamine (Ethoduomeen T/13 manufactured by Lion-Armour Co., Ltd.) and an adduct (F) of 2 moles of ethylene oxide to 1 mole of coconut-alkyl amine (Ethomeen C/12 manufactured by Lion-Armour Co., Ltd.).

Table 8

| Ingredients | Recipe (% by weight) | | | | | | |
|---|---|---|---|---|---|---|---|
| | Run 1* | Run 2 | Run 3 | Run 4 | Run 5 | Run 6* | Run 7* |
| Liquid paraffin | 46.0 | 45.75 | 45.5 | 45 | 44 | 42.5 | 41 |
| Alkylbenzene oil | 46.0 | 45.75 | 45.5 | 45 | 44 | 42.5 | 41 |
| Activating agent (E) | 2.5 | 2.5 | 2.5 | 2.5 | 2.5 | 2.5 | 2.5 |
| Activating agent (F) | 2 | 2 | 2 | 2 | 2 | 2 | 2 |
| Butyl benzoate | 0 | 0.5 | 1.0 | 2 | 4 | 7 | 10 |
| Butyl Cellosolve | 3.5 | 3.5 | 3.5 | 3.5 | 3.5 | 3.5 | 3.5 |

*Oiling compositions used in Runs 1, 6 and 7 were outside the scope of the present invention.

In water was dipped 100 parts by weight of a cotton cloth at a liquor ratio of 10 : 1, and the pH of the bath was adjusted to 5.0 by additiion of acetic acid. Then, 20 parts by weight of the above oiling composition was added to the bath to form an emulsion. The emulsion was agitated at a liquid temperature of 20° C. to adsorb the particles of the oiling composition in fibers. Post treatments were carried out in the same manner as described in Example 1. Obtained results are shown in Table 9.

Table 9

| Test Item | Run 1 | Run 2 | Run 3 | Run 4 | Run 5 | Run 6 | Run 7 |
|---|---|---|---|---|---|---|---|
| Distribution (numerical %) of particles smaller than 10 μ in emulsion | 75 | 91 | 94 | 95 | 96 | 98 | 98 |
| Time (minutes) of exhaustion in fibers | 10 | 13 | 18 | 19 | 26 | above 60* | above 60* |
| State of treating liquid after absorption | slightly | trans- | trans- | trans- | trans- | opaque | opaque |

Table 9-continued

| Test Item | Run 1 | Run 2 | Run 3 | Run 4 | Run 5 | Run 6 | Run 7 |
|---|---|---|---|---|---|---|---|
| treatment | opaque | parent | parent | parent | parent | | |
| Oiling agent exhaustion ratio (%) (retention ratio) | | | | | | | |
| (i) before dehydration | 96.8 | 97.5 | 98.7 | 99.2 | 99.0 | 87.4 | 74.7 |
| (ii) after dehydration | 81.5 | 97.3 | 98.6 | 99.0 | 98.7 | 87.3 | 74.6 |
| (iii) after drying | 79.8 | 96.5 | 98.6 | 98.9 | 98.7 | 87.1 | 74.6 |
| (iv) deviation in final product | 75.2–92.8 | 95.2–98.0 | 98.1–99.3 | 98.4–99.6 | 98.0–99.5 | 85.2–88.5 | 72.8–75.9 |
| Amount (mg/Nm$^3$) of oiling agent evaporated in air | 85 | 41 | 42 | 40 | 46 | 150 | 240 |
| Amount (mg/cm$^2$) of dust adsorbed | 24.1 | 25.1 | 26.3 | 25.0 | 23.8 | 20.1 | 18.7 |
| Amount ($\mu$g/cm$^2$) of oil transferred on wiped surface | 1.61 | 1.43 | 1.25 | 1.34 | 1.55 | 1.85 | 2.13 |

*the oiling composition was not completely adsorbed.

From the results shown in Table 9, it will readily be understood that by using a specific surface active agent and a specific emulsion stabilizer in combination according to the present invention, it is made possible to adsorb the oiling composition tightly and uniformly in fibers of the fibrous substrate for a cleaning material.

What is claimed is:

1. A process for the preparation of cleaning materials comprising a cleaning fibrous substrate and an oiling composition adsorbed and impregnated in said fibrous substrate, said process comprising contacting a cleaning fibrous substrate composed of cellulose fibers or a combination of up to 30% by weight, based on the fibers, of synthetic fibers and the remainder of cellulose fibers with an oil-in-water emulsion of an oiling composition consisting essentially of (a) an oiling agent composed of mineral oil, a synthetic lubricating oil or a mixture thereof and having a viscosity of 8 to 100 cps as measured at 100° F, (b) 0.5 to 35% by weight, based on the total oiling composition, of an amphoteric surface active agent or a surface active agent having in the molecule both cationic active and non-ionic active groups and (c) 1 to 4% by weight based on the total oiling composition, of a benzene-carboxylic acid ester having a solubility parameter of from 8 to 12.6, at a pH of 4.0 to 5.0, for a time of 5 to 20 minutes and sufficient for the emulsion to be rendered transparent, said oil-in-water emulsion having a particle size distribution in which the number of particles having a size smaller than 10$\mu$ occupies at least 85% of the total number of dispersed particles, the oiling composition being present in an amount of 0.5 to 35% by weight based on the fibrous substrate on the dry basis; dehydrating the thus oil-impregnated fibrous substrate so that the water content is lower than 70% by weight; and then drying the fibrous substrate.

2. A process according to claim 1 wherein the benzene-carboxylic acid ester is a compound represented by the following general formula:

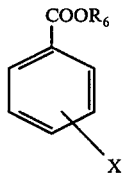

wherein $R_6$ stands for an alkyl group having up to 6 carbon atoms, and X stands for a hydrogen atom, a hydroxyl group, an alkyl or alkoxy group having up to 6 carbon atoms or a group —$COOR_6$.

3. A process according to claim 1 wherein te benzene-carboxylic acid ester is butyl benzoate.

4. A process according to claim 1 wherein the benzene-carboxylic acid ester is butyl hydroxybenzoate.

5. A process according to claim 1 wherein the surface active agent is a product formed by addition reaction of 2 to 5 moles of ethylene oxide to a cationic surface active agent having active hydrogen atoms.

6. A process according to claim 1 wherein the surface active agent is at least one member selected from the group consisting of (i) compounds represented by the following general formula:

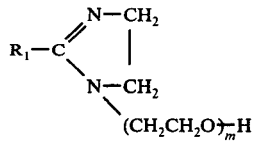

wherein $R_1$ stands for a long-chain alkyl group having at least 8 carbon atoms and *m* is a number of from 2 to 5, and (ii) compounds represented by the following general formula:

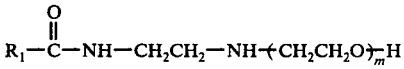

wherein $R_1$ stands for a long-chain alkyl group having at least 8 carbon atoms and *m* is a number of from 2 to 5.

7. A process according to claim 6 where the surface active agent is a mixture containing the compound (i) and the compound (ii) at a ratio ranging from 5 : 5 to 9 : 1.

8. A process according to claim 1 wherein the surface active agent is a compound represented by the following general formula:

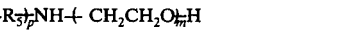

wherein $R_1$ stands for a long-chain alkyl group having at least 8 carbon atoms, $R_5$ stands for an alkylene group having 2 to 3 carbon atoms, *p* is 0 or 1, and *m* is a number of from 2 to 5.

9. A process according to claim 1 wherein the oiling agent is a member selected from the group consisting of liquid paraffin and alkylbenzene oil.

10. A process according claim 1 wherein the oiling composition contains 0.3 to 8 % by weight of a water-miscible organic solvent.

11. A process for the preparation of oil-impregnated cleaning materials which comprises dipping in an aqueous medium having a pH of 4.0 to 5.0 a cleaning fibrous substrate composed of cellulose fibers or a combination of up to 30% by weight, based on the total fibers, of synthetic fibers and the remainder of cellulose fibers, ; adding to the aqueous medium 0.5 to 35% by weight, based on the fibers on the dry basis, of a self-emulsifiable oiling composition consisting essentially of (a) a major amount of a mineral oil or synthetic lubricating oil which is substantially non-volatile in the normal state and has a viscosity of 8 to 100 cps as measured at 100° F., a flash point of at least 130° C., a vapor pressure lower than 1 mm Hg at 70° C., an aniline point of at least 20 and a boiling point of at least 280° C., (b) 0.5 to 35% by weight, based on the oiling composition, of at least one surface active agent selected from the group consisting of compounds represented by the following general formula:

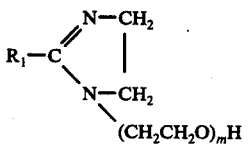

wherein $R_1$ stands for a long-chain alkyl group having at least 8 carbon atoms and *m* is a number of from 2 to 5, and compounds represented by the following general formula:

$$R_1—C—CH_2—CH_2—NH\text{-}(CH_2CH_2O)_m\text{-}H$$

wherein $R_1$ and *m* are as defined above, and (c) 1 to 4% by weight, based on the oiling composition, of a benzene-carboxylic acid ester having a solubility parameter of from 8 to 12.6 and being represented by the following general formula:

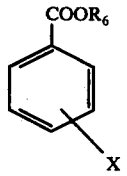

wherein $R_6$ stands for an alkyl group having up to 6 carbon atoms, and X stands for a hydrogen atom, a hydroxyl group, an alkyl or alkoxy group having up to 6 carbon atoms or a group $-COOR_6$, to thereby form an emulsion of the oiling composition in which the number of particles having a size smaller than 10μ occupies at least 85% of the total number of dispersed particles; contacting said fibrous substrate with the so formed emulsion at a temperature of 5° to 70° C. to adsorb and exhaust the oiling composition into the fibrous substrate in a time of 5 to 20 minutes; dehydrating the so treated fibrous substrate so that the water content in the fibrous substrate is lower than 70% by weight; and drying the so dehydrated fibrous substrate.

12. A process according to claim 1 in which the oiling composition consists essentially of (a) in an amount of at least 60% by weight, (b) in an amount of 1 to 30% by weight, and (c) in an amount of 1 to 4% by weight, said benzenecarboxylic acid ester having solubility parameter of from 9 to 12.6.

13. A process according to claim 10 wherein the water-miscible organic solvent is selected from the group consisting of methanol, ethanol, isopropanol, ethylene glycol, diethylene glycol, propylene glycol, ethylene glycol monomethyl ether, ethylene glycol monoethyl ether, ethylene glycol monobutyl ether, glycerin, monoethanolamine, diethanol amine and triethanol amine.

14. A process according to claim 1 in which the cleaning fibrous substrate picks up by adsorption and impregnation from 8 to 50% by weight of oiling composition, based on the weight of the dry substrate.

15. A process according to claim 14 in which the amount of oiling composition adsorbed by the impregnated in the fibrous substrate is 10 to 35% by weight based on the weight of the substrate.

16. A process according to claim 1 in which the oil-in-water emulsion has a particle size distribution in which the number of particles having a size smaller then 10μ occupies at least 90% of the total number of dispersed particles.

17. a process according to claim 11 in which the benzene-carboxylic acid ester is butyl benzoate, dibutyl phthalate or butyl-p-hydroxybenzoate.

18. A process according to claim 17 in which the number of particles having a size smaller than 10μ occupies at least 90% of the total number of dispersed particles.

* * * * *

UNITED STATES PATENT OFFICE

CERTIFICATE OF CORRECTION

Patent No. 4,075,375 Dated February 21, 1978

Inventor(s) Komatsu

It is certified that error appears in the above-identified patent and that said Letters Patent are hereby corrected as shown below:

Claim 3, line 1, delete "te", insert --the--

Claim 15, line 2, delete "the", insert --and--

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*